United States Patent [19]

Mal et al.

[11] 4,174,967

[45] Nov. 20, 1979

[54] TITANIUM CARBIDE TOOL STEEL COMPOSITION FOR HOT-WORK APPLICATION

[75] Inventors: M. Kumar Mal, Spring Valley; Stuart E. Tarkan, Monsey, both of N.Y.

[73] Assignee: Chromalloy American Corporation, West Nyack, N.Y.

[21] Appl. No.: 872,910

[22] Filed: Jan. 27, 1978

[51] Int. Cl.[2] ..... B22F 5/00; C22C 33/02; C22C 38/14; C22C 29/00

[52] U.S. Cl. ..... 75/237; 75/243

[58] Field of Search ..... 75/237, 243

[56] References Cited

U.S. PATENT DOCUMENTS

| | | | |
|---|---|---|---|
| 3,416,976 | 12/1968 | Brill-Edwards | 75/237 |
| 3,653,982 | 4/1972 | Prill | 75/237 |
| 3,811,961 | 5/1974 | Weinstein et al. | 148/34 |
| 3,977,837 | 8/1976 | Mal et al. | 75/203 |

FOREIGN PATENT DOCUMENTS

| | | | |
|---|---|---|---|
| 305201 | 7/1971 | U.S.S.R. | 75/204 |

*Primary Examiner*—Brooks H. Hunt

*Attorney, Agent, or Firm*—Hopgood, Calimafde, Kalil, Blaustein and Lieberman

[57] ABSTRACT

A sintered titanium carbide tool steel composition is provided comprising by weight about 15% to 40% primary grains of titanium carbide dispersed through a steel matrix making up the balance, the composition of said steel matrix consisting essentially by weight of about 3% to 7% chromium, about 2% to 6% molybdenum, about 2% to 8% nickel, about 0.2% to 0.6% carbon and the balance essentially iron.

2 Claims, No Drawings

TITANIUM CARBIDE TOOL STEEL COMPOSITION FOR HOT-WORK APPLICATION

This invention relates to a sintered titanium carbide tool steel composition and to a hardened wear resistant die element of said composition particularly suitable for use in hot working applications.

STATE OF THE ART

Titanium carbide tool steel compositions are disclosed in U.S. Pat. No. 2,828,202 (assigned to the same assignee) comprising broadly primary grains of essentially titanium carbide distributed through a heat treatable steel matrix. A typical composition is one containing by weight 33% TiC in the form of primary carbide grains dispersed through a steel matrix, the steel matrix containing by weight 3% Cr, 3% Mo, 0.6% C and the balance essentially iron. The steel is preferably produced using powder metallurgy methods which comprise broadly mixing powdered titanium carbide (primary carbide grains) with powered steel-forming ingredients of, for example, the aforementioned composition, forming a compact by pressing the mixture in a mold and then subjecting the compact to liquid phase sintering under non-oxidizing conditions, such as in a vacuum. The term "primary carbide" employed herein is meant to cover the titanium carbide grains per se added directly in making up the composition and which grains are substantially unaffected by heat treatment.

In producing a titanium carbide tool steel composition containing, for example, about 33% by weight of TiC (approximately 45 volume percent) and substantially the balance a steel matrix, about 500 grams of TiC (of about 5 to 7 microns in size) are mixed with 1000 grams of steel-forming ingredients in a mill half filled with stainless steel balls. To the powder ingredients is added one gram of paraffin wax for each 100 grams of mix. The milling is conducted for about 40 hours, using hexane as a vehicle.

After completion of the milling, the mix is removed and dried and compacts of a desired shape pressed at about 15 t.s.i. and the compacts then subjected to liquid phase sintering in vacuum at a temperature of about 2640° F. (1450° C.) for about one-half hour at a vacuum corresponding to 20 microns of mercury or better. After completion of the sintering, the compacts are cooled and then annealed by heating to about 1650° F. (900° C.) for 2 hours followed by cooling at a rate of about 27° F. (15° C.) per hour to about 212° F. (100° C.) and thereafter furnace cooled to room temperature to produce an annealed microstructure containing spheroidite. The annealed hardness is in the neighborhood of about 45 $R_C$ and the high carbon tool steel is capable of being machined and/or ground into any desired tool shape or machine part prior to hardening.

The hardening treatment comprises heating the machined piece to an austenitizing temperature of about 1750° F. for about one-quarter hour followed by quenching in oil to produce a hardness in the neighborhood of about 70 $R_C$.

While the foregoing typical composition has achieved some measure of commercial success, it has certain disadvantages. For example, when used as die material, under conditions in which heat is generated due to friction, or where the metal being worked upon has been preheated, over-tempering tended to occur, leading to softening of the die steel. In addition, unless care was taken to avoid rapid heating and cooling, a part made of the composition would be subject to thermal cracking. Moreover, the transverse rupture strength, while adequate for most uses, was not as high as desired, the transverse rupture strength usually ranging from about 250,000 p.s.i. to about 300,000 p.s.i.

Another type of steel-bonded carbide is that disclosed in U.S. Pat. No. 3,653,982 (also assigned to the same assignee), a typical commercial composition being one containing by weight about 34.5% TiC as primary carbide grains dispersed through a steel matrix making up essentially the balance. The steel matrix contains by weight based on the matrix itself about 10% Cr, 3% Mo, 0.85% C and the balance essentially iron. This steel-bonded carbide differs from the aforementioned lower-chromium variety in that it is capable of being tempered to about 1000° F. (538° C.) and thus is capable of retaining fairly high hardness at such temperatures, particularly when used as an apex wear resistant seal strip in rotary piston engines, such as the Wankel engine. However, this composition, like the previously discussed composition, is subject to thermal shock and usually exhibits a transverse rupture strength ranging from about 250,000 p.s.i. to 300,000 p.s.i. However, this steel-bonded carbide is only capable of resisting softening up to about 950° F. or 1000° F. and, therefore, finds limited use as die material in certain hot working applications.

A steel-bonded carbide composition which exhibits resistance to softening at elevated temperatures is one covered by U.S. Pat. No. 3,053,706 (also assigned to the same assignee). A typical composition is one in which the refractory carbide is a solid solution carbide of the type $WTiC_2$ containing about 75% WC and 25% TiC. This carbide, preferably in an amount by weight of 45.6%, is dispersed through a steel matrix making up essentially the balance. The matrix which is capable of secondary hardening at 1000° F. to 1200° F. (538° C. to 650° C.) typically may contain 12% W, 5% Cr, 2% V, 0.85% C and the balance essentially iron. The dissolved tungsten in the matrix is in equilibrium with the saturated solution of the primary carbide. While the foregoing composition is satisfactory in providing the necessary secondary hardening effect to resist tempering at warm die-working temperatures, these compositions tended to be porous. For example, as pointed out in column 4 of the patent, lines 4 to 9, the composition was satisfactory in producing a sintered slug one-half inch thick. However, it was subsequently found that, in producing large sizes for use in dies, for example, sizes of about 1½ inches square and larger, the finally sintered product tended to be porous. In addition, the transverse rupture strength was not all that was desired, the transverse rupture ranging from about 220,000 p.s.i. to 250,000 p.s.i.

A still further development is disclosed in U.S. Pat. No. 3,809,540 (also assigned to the present assignee) in which the steel-bonded titanium carbide composition comprises a steel matrix containing limited amounts of nickel ranging from about 0.1% to 1% by weight of the matrix composition. This steel-bonded titanium carbide composition contains by weight about 20% to 30% of primary grains of titanium carbide dispersed through a steel matrix making up essentially the balance of about 80% to 70%, said matrix consisting essentially by weight of about 3% to 7% chromium, about 2% to 6% molybdenum, about 0.1% to 1% nickel, about 0.3% to 0.7% carbon and the balance essentially iron.

A particular composition is one containing 24% to 30% titanium carbide and the balance essentially the steel matrix of about 76% to 70%, the steel matrix consisting essentially by weight of about 4% to 6% chromium, about 3% to 5% molybdenum, about 0.25% to 0.75% nickel, about 0.3% to 0.5% carbon and the balance essentially iron.

According to the aforementioned patent, it is stated that, by adding nickel over a controlled range to the matrix, improved resistance to thermal shock is obtained combined with improved transverse rupture strength.

Thus, by employing nickel in the matrix over the range of about 0.1% to 1% and, preferably over the range of about 0.25% to 0.75%, transverse rupture strengths of over 325,000 psi and even over 350,000 psi are obtained, accompanied by improved resistance to thermal shock. However, a limitation of the aforementioned steel-bonded titanium carbide alloy is that it does not have the capability of resisting softening at temperatures above 950° F. or 1000° F. (510° C. or 538° C.), especially in hot working applications conducted at relatively high hot working temperatures.

Tooling and component part manufacturers have been constantly seeking newer and better die materials capable of withstanding stresses, thermal shock, impact, heat and wear encountered in certain hot work and impact-involving applications, including such die elements as warm heading dies, swedgind dies, forging dies, die casting tools, and the like. This demand has created an urgent need for steel-bonded titanium carbide die material having a unique combination of physical and mechanical properties at room and elevated temperatures, such as resistance to impact and such as high transverse rupture strength in combination with high resistance to thermal shock.

OBJECTS OF THE INVENTION

It is thus the object of the invention to provide a titanium carbide tool steel composition having improved combination of physical and thermal properties.

Another object is to provide as an article of manufacture, a hardened wear resistant die element characterized by a high degree of resistance to wear, in combination with improved physical and mechanical properties and optimum resistance to thermal shock.

These and other objects will more clearly appear from the following disclosure and the appended claims.

STATEMENT OF THE INVENTION

Stating it broadly, the invention resides in a sintered titanium carbide tool steel composition having particular use as a hardened die element in hot working applications, said composition comprising by weight about 15% to 40% primary grains of titanium carbide dispersed through a steel matrix making up essentially the balance (e.g. 85% to 60% by weight of the tool steel composition), the composition of the steel matrix consisting essentially by weight of about 3% to 7% chromium, about 2% to 6% molybdenum, about 2% to 8% nickel, about 0.2% to 0.6% carbon and the balance essentially iron.

A preferred composition is one containing by weight 20% to 30% titanium carbide with the steel matrix making up essentially the balance (e.g. 80% to 70% by weight of the tool steel composition), the composition of the steel matrix consisting essentially of about 4% to 6% chromium, about 3% to 5% molybdenum, about 3% to 7% nickel, about 0.3% to 0.5% carbon and the balance essentially iron.

A specific composition comprises by weight about 25% titanium carbide and 75% steel matrix, the steel matrix consisting essentially by weight of about 5% chromium, about 4% molybdenum, about 5% nickel, about 0.4% carbon and the balance essentially iron.

Tool steel characteristics considered essential for hot-work applications include structural soundness and uniformity, resistance to gross heat checking, good thermal conductivity, ability to resist softening at elevated working temperatures, optimum toughness to resist cracking and resistance to erosion at the mating surfaces of the die and workpiece.

We have found that the titanium carbide tool steel composition of the invention has the desired combination of physical and thermal properties, to wit: improved resistance to thermal shock, to impact, to wear and the desirable high temperature hardness for resisting deformation at elevated hot working temperature. The foregoing enables the use of the novel composition in the field of hot forging, hot rolling and for dies in the die casting field. The term "die element" employed in certain of the claims is meant to cover all such applications.

As illustrative of one embodiment of the invention, the following example is given.

EXAMPLE

A sintered composition containing by weight about 25% TiC and about 75% of the steel matrix (5% Cr, 4% Mo, 5% Ni, 0.4% C and the balance essentially iron) is produced as follows.

About 1000 grams of titanium carbide powder of about 5 to 7 microns average size are mixed with 3000 grams of steel-forming ingredients of the foregoing composition of 20 microns average size in a steel ball mill (stainless steel balls). The carbon added to the mix takes into account any free carbon in the titanium carbide raw material. To the mix is added one gram of paraffin wax for each 100 grams of mix. The milling is conducted for about 40 hours with the mill half full of steel balls of about one-half inch in diameter using hexane as the vehicle.

After completion of the milling, the mix is removed and vacuum dried. A predetermined amount of the mixed powder is compressed in a die at about 15 tons per square inch (t.s.i.) to the desired shape. The shape is liquid phase sintered,, that is, sintered above the melting point of the matrix composition, at a temperature of about 1435° C. for one hour in vacuum, e.g., a vacuum corresponding to 20 microns of mercury or better. After completion of sintering, the shape is cooled to ambient temperature. The as-sintered hardness was about 57 $R_C$.

The sintered part is then annealed at 650° C. (1200° F.) for 24 hours to provide an annealed hardness of about 44 $R_C$. At this hardness, the sintered part can be machined to the desired shape prior to hardening by heat treatment.

The hardening treatment comprised heating the annealed part to a temperature of about 870° C. (1600° F.) for two hours and then air cooling to ambient temperature, the hardness obtained being about 65 $R_C$. It is recommended that the hardened part be tempered by heating the part for about ¼ to 1 hour at a temperature ranging from about 212° F. to 350° F. (about 100° C. to 175° C.). At 150° C., the part was tempered from 65 $R_C$ to 64.4 $R_C$. The hardening heat treatment is advantageous over that employed in U.S. Pat. No. 3,809,540 (low nickel steel matrix) in that the low-nickel titanium carbide tool steel is oil quenched from a relatively high temperature of 1875° F. (about 1025° C.). Such quenches can effect dimensional changes in the part and also produce thermal stresses therein. The transverse rupture of the foregoing alloy of the invention in the hardened condition was determined as 380,000 psi. While this value is not quite as high as the optimum transverse rupture values obtained with the low-nickel titanium carbide tool steel, nevertheless the transverse rupture property is very good when considered with the fact that the alloy which is hardenable at 1600° F. (870° C.) is capable of resisting softening at high hot working temperatures in excess of 950° F. or 1000° F. (510° C. or 538° C.).

An advantage of the alloy composition is that when employed as a die element at elevated working temperatures of above 1200° F., e.g. 1600° F., it self-hardens during air cooling from the working temperature. The self-hardening property aids in providing longer life.

Thermal shock tests were carried out comparing the titanium carbide tool steel of the invention with other tool steel compositions as follows:

| | |
|---|---|
| (1) | 25% TiC - 75% steel matrix; matrix - 5% Cr, 4% Mo, 5% Ni, 0.4% C and the balance essentially iron. (The Invention) |
| (A) | 33% TiC - 67% steel matrix; matrix - 3% Cr, 3% Mo, 0.6% C and balance essentially iron. (U.S. Patent No. 2,828,202) |
| (B) | 34.5% TiC - 65.5% steel matrix matrix - 10% Cr, 3% Mo, 0.85% C and the balance essentially iron. (U.S. Patent No. 3,653,982) |
| (C) | 45.6% $WTiC_2$ - 54.4% steel matrix; matrix - 12% W, 5% Cr, 2% V, 0.85% C and the balance essentially iron. (U.S. Patent No. 3,053,706) |
| (D) | 25% TiC - 75% steel matrix; matrix - 5% Cr, 4% Mo, 0.5% Ni, 0.4% C and the balance essentially iron. (U.S. Patent No. 3,809,940) |

The foregoing compositions were produced by sintering as similarly described herein for the titanium carbide tool steel alloy of the invention. All compositions were compared in the hardened state using the following thermal shock test.

The resistance to thermal shock is conducted by repeatedly heating rectangular ground pieces of approximately 1 inch × 1 inch × ¼ inch in size to 1500° F. (815° C.) and quenching into oil maintained at room temperature. The heating and quenching cycle is repeated until thermal cracks are formed. The number of cycles before cracking sets in is taken as a measure of resistance to thermal shock. The results obtained are as follows:

| Material Tested | Number of Cycles Sustained Before Thermal Cracking Occurred |
|---|---|
| (A) | 4 |
| (B) | 2 |
| (C) | 1 |
| (D) | 15 |
| (1) [The Invention] | 17 |

As will be noted from the foregoing table, the invention exhibits superior resistance to thermal shock which is an important property where the material is used as a die element for hot working application at elevated temperatures, e.g. forging dies, extrusion dies, die-casting dies, hot rolling dies, and the like.

Various microstructures can be produced according to the heat treatment employed, the microstructure being an austenitic decomposition product. Thus, in the annealed state, the microstructure is pearlite (e.g. spheroidized pearlite). In the hardened state, the microstructure may contain essentially martensite, or bainite or both. Generally speaking, the microstructure is an austenitic decomposition product selected from the group consisting of pearlite, bainite and martensite.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A sintered titanium carbide tool steel composition suitable as die material for hot working applications characterized by an improved combination of resistance to thermal shock, impact and wear and by resistance to softening at elevated temperatures, said sintered composition comprising by weight about 20% to 30% primary grains of titanium carbide dispersed through a steel matrix making up the balance, the composition of said matrix consisting essentially by weight of about 4% to 6% chromium, about 3% to 5% molybdenum, about 3% to 7% nickel, about 0.3% to 0.5% carbon and the balance essentially iron, said matrix surrounding the primary grains of titanium carbide being characterized by a microstructure of an austenitic decomposition product.

2. As an article of manufacture, a hardened wear resistant die element suitable for hot working applications, said element being made of a sintered titanium carbide tool steel composition characterized by an improved combination of resistance to thermal shock, impact and wear and by resistance to softening at elevated temperature, said sintered composition comprising by weight about 20% to 30% primary grains of titanium carbide dispersed through a steel matrix making up the balance, the composition of said matrix consisting essentially by weight of about 4% to 6% chromium, about 3% to 5% molybdenum, about 3% to 7% nickel, about 0.3% to 0.5% carbon and the balance essentially iron, said steel matrix being characterized by a microstructure comprising martensite.

* * * * *